US009116486B2

(12) United States Patent
Harashima

(10) Patent No.: US 9,116,486 B2
(45) Date of Patent: Aug. 25, 2015

(54) CONTROL DEVICE, CONTROL METHOD, AND IMAGE FORMING APPARATUS

(75) Inventor: Yasumitsu Harashima, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 773 days.

(21) Appl. No.: 13/198,364

(22) Filed: Aug. 4, 2011

(65) Prior Publication Data

US 2012/0213537 A1 Aug. 23, 2012

(30) Foreign Application Priority Data

Feb. 23, 2011 (JP) ..... 2011-036899

(51) Int. Cl.
*G03G 15/00* (2006.01)
*G03G 15/01* (2006.01)

(52) U.S. Cl.
CPC ..... *G03G 15/5058* (2013.01); *G03G 15/0189* (2013.01); *G03G 2215/0129* (2013.01); *G03G 2215/0164* (2013.01)

(58) Field of Classification Search
USPC ..... 399/49
See application file for complete search history.

(56) References Cited

U.S. PATENT DOCUMENTS

2005/0260004 A1* 11/2005 Maebashi et al. ..... 399/15
2009/0208233 A1 8/2009 Hirai

FOREIGN PATENT DOCUMENTS

JP 08-286442 A 11/1996
JP 2004-029217 A 1/2004
JP 2008164933 A * 7/2008
JP 2009-198610 A 9/2009
JP 2010-117736 A 5/2010
JP 2010186016 A * 8/2010
JP 2011085646 A * 4/2011

OTHER PUBLICATIONS

English translation of communication dated Nov. 11, 2014, issued by the Japanese Patent Office in counterpart Japanese application No. 2011-036899.

* cited by examiner

*Primary Examiner* — Erika J Villaluna
(74) *Attorney, Agent, or Firm* — Sughrue Mion, PLLC

(57) ABSTRACT

A control device includes an acquiring unit acquiring code image data expressing a code image having dots arranged in an array that expresses information; a generating unit extracting the dots from the code image and generating patch image data expressing patch images having the dots orderly arranged in different densities; an image-formation control unit controlling an image forming unit so as to form the patch images based on the patch image data in accordance with a preset image forming condition by using an invisible toner; a measuring unit measuring densities of the patch images; and a changing unit changing the image forming condition if at least one measured density is outside a density range set according to a corresponding dot density based on a correspondence relationship between the measured densities and densities of the dots, so that all of the measured densities are set within the corresponding density ranges.

15 Claims, 7 Drawing Sheets

CONTROL DEVICE, CONTROL METHOD, AND IMAGE FORMING APPARATUS

CROSS-REFERENCE TO RELATED APPLICATIONS

This application is based on and claims priority under 35 USC 119 from Japanese Patent Application No. 2011-036899 filed Feb. 23, 2011.

BACKGROUND

Technical Field

The present invention relates to control devices, control methods, and image forming apparatuses.

SUMMARY

According to an aspect of the invention, there is provided a control device including an acquiring unit, a generating unit, an image-formation control unit, a measuring unit, and a changing unit. The acquiring unit acquires code image data expressing a code image having dots that are arranged in an array that expresses information. The generating unit extracts the dots from the code image expressed by the acquired code image data and generates patch image data expressing multiple patch images in which the extracted dots are orderly arranged in different densities. The image-formation control unit controls an image forming unit so that the image forming unit forms the multiple patch images on the basis of the generated patch image data in accordance with a preset image forming condition by using an invisible toner that absorbs infrared light or ultraviolet light. The measuring unit measures densities of the multiple patch images formed by the image forming unit. Based on a correspondence relationship between the densities of the multiple patch images measured by the measuring unit and densities of the dots in the multiple patch images, if at least one of the measured densities is outside a density range set in accordance with the density of the corresponding dots, the changing unit changes the image forming condition so that all of the measured densities are set within corresponding density ranges set in accordance with the densities of the corresponding dots.

BRIEF DESCRIPTION OF THE DRAWINGS

An exemplary embodiment of the present invention will be described in detail based on the following figures, wherein.

DETAILED DESCRIPTION

Figure 1:
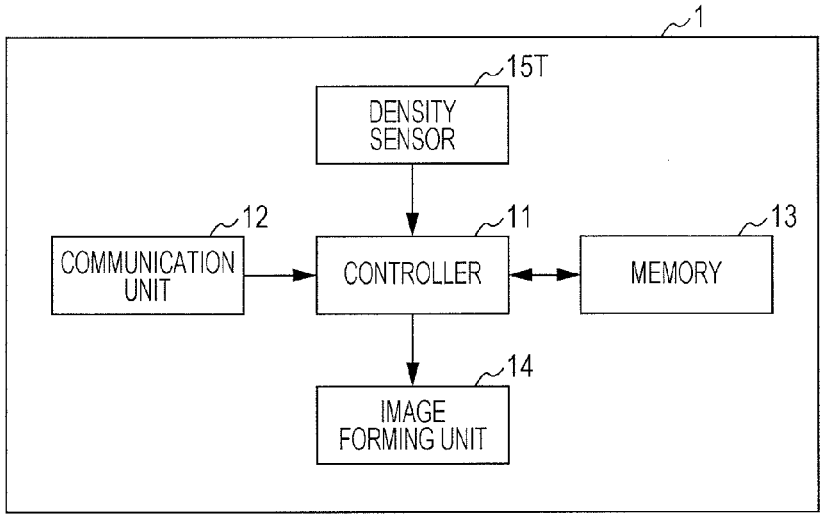
FIG. 1 illustrates the configuration of an image forming apparatus.

FIG. 1 illustrates the configuration of an image forming apparatus 1 according to an exemplary embodiment of the invention. The image forming apparatus 1 includes a controller 11, a communication unit 12, a memory 13, an image forming unit 14, and a density sensor 15T. The controller 11 includes a central processing unit (CPU) and a memory. The CPU executes a program stored in the memory so as to control each component in the image forming apparatus 1. The communication unit 12 performs communication with a terminal apparatus (not shown) via a communication line. The memory 13 includes, for example, a hard disk and stores various kinds of data.

Figure 2:
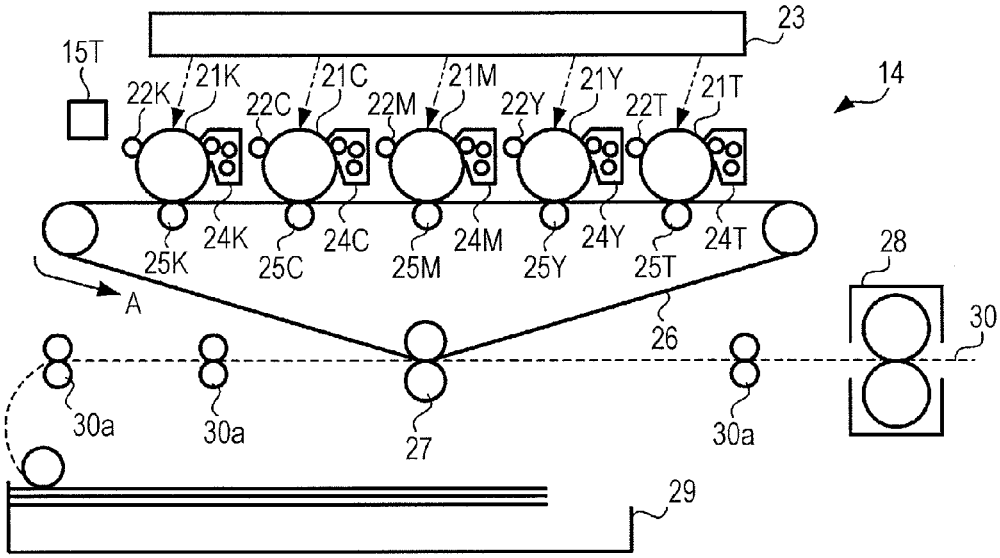
FIG. 2 illustrates the configuration of an image forming unit.

FIG. 2 illustrates the configuration of the image forming unit 14. The image forming unit 14 includes photoconductor drums 21Y, 21M, 21C, 21K, and 21T. Each of the photoconductor drums 21Y, 21M, 21C, 21K, and 21T has a photosensitive layer and rotates about a shaft. The photoconductor drums 21Y, 21M, 21C, 21K, and 21T are respectively surrounded by chargers 22Y, 22M, 22C, 22K, and 22T, an exposure device 23, developing devices 24Y, 24M, 24C, 24K, and 24T, and first-transfer rollers 25Y, 25M, 25C, 25K, and 25T.

The chargers 22Y, 22M, 22C, 22K, and 22T uniformly electrostatically-charge the surfaces of the photoconductor drums 21Y, 21M, 21C, 21K, and 21T, respectively. The exposure device 23 exposes the electrostatically-charged photoconductor drums 21Y, 21M, 21C, 21K, and 21T to light so as to form electrostatic latent images thereon. Based on preset development potential, the developing devices 24Y, 24M, 24C, 24K, and 24T develop the electrostatic latent images formed on the photoconductor drums 21Y, 21M, 21C, 21K, and 21T by using toner so as to form toner images. The developing devices 24Y, 24M, 24C, and 24K respectively accommodate yellow, magenta, cyan, and black toners and use the respective toners to perform the developing process. The developing device 24T accommodates an invisible toner and uses the invisible toner to perform the developing process. This invisible toner is substantially transparent relative to visible light and absorbs infrared light or ultraviolet light. Since such an invisible toner absorbs a small amount of visible light, the toner readily becomes visually recognizable as the amount of toner increases. The term "invisible" refers to a state in which an object is difficult to visually recognize, regardless of whether the object is visually recognizable in actuality.

Based on preset first transfer bias, the first-transfer rollers 25Y, 25M, 25C, 25K, and 25T transfer the toner images formed on the photoconductor drums 21Y, 21M, 21C, 21K, and 21T onto an intermediate transfer belt 26. The intermediate transfer belt 26 rotates in a direction indicated by an arrow A in FIG. 2 so as to transport the toner images transferred thereto by the first-transfer rollers 25Y, 25M, 25C, 25K, and 25T to a second-transfer roller 27. The second-transfer roller 27 transfers the toner images transported thereto by the intermediate transfer belt 26 to a recording medium. This recording medium is, for example, a sheet of paper. A fixing unit 28 fixes the toner images onto the recording medium by applying heat and pressure thereto. A feeding unit 29 accommodates multiple recording media and feeds the accommodated recording media in a one-by-one manner. A transport unit 30 has multiple transport rollers 30a and transports each recording medium fed from the feeding unit 29 to an outlet via the second-transfer roller 27 and the fixing unit 28.

As shown in FIG. 2, the density sensor 15T is provided above the intermediate transfer belt 26. The density sensor 15T emits light to an invisible toner image on the intermediate transfer belt 26 and detects reflected light thereof so as to measure the optical density of the invisible toner image.

Figure 3:
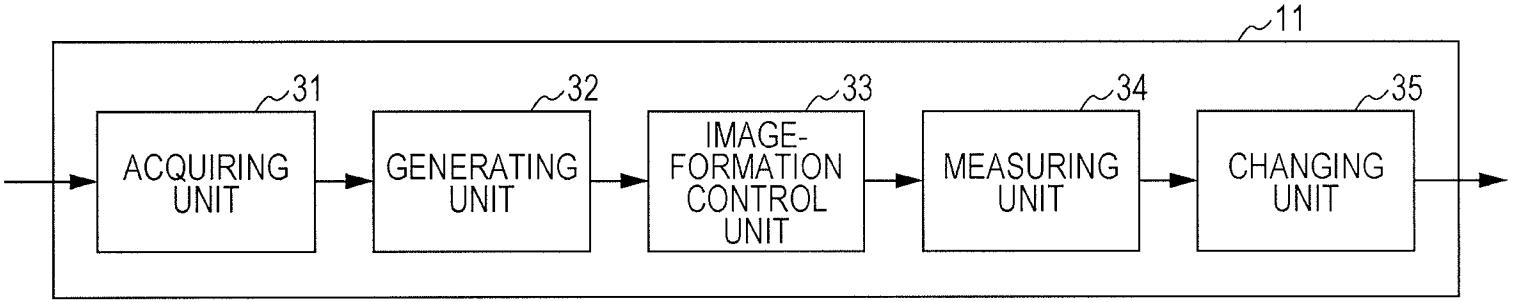
FIG. 3 illustrates a functional configuration of a controller and a density sensor.

FIG. 3 illustrates a functional configuration of the controller 11 and the density sensor 15T. An acquiring unit 31, a generating unit 32, an image-formation control unit 33, and a changing unit 35 are implemented by the controller 11. A measuring unit 34 is implemented by the density sensor 15T. The acquiring unit 31 acquires code image data expressing a code image having dots that are arranged in an array that expresses information. The generating unit 32 extracts the dots from the code image expressed by the code image data acquired by the acquiring unit 31 and generates patch image data expressing multiple patch images in which the extracted dots are orderly arranged in different densities. Based on the patch image data generated by the generating unit 32, the image-formation control unit 33 controls the image forming unit 14 so that the image forming unit 14 forms the multiple patch images in accordance with a preset image forming condition by using the invisible toner. The measuring unit 34 measures the densities of the multiple patch images formed by the image forming unit 14. Based on a correspondence relationship between the densities of the patch images measured by the measuring unit 34 and the densities of the dots in the corresponding patch images, if at least one of the densities measured by the measuring unit 34 is outside a density range set in accordance with the density of the corresponding dots, the changing unit 35 changes the image forming condition of the image forming unit 14 so that all of the densities measured by the measuring unit 34 are set within corresponding density ranges set in accordance with the densities of the corresponding dots.

Figure 4:
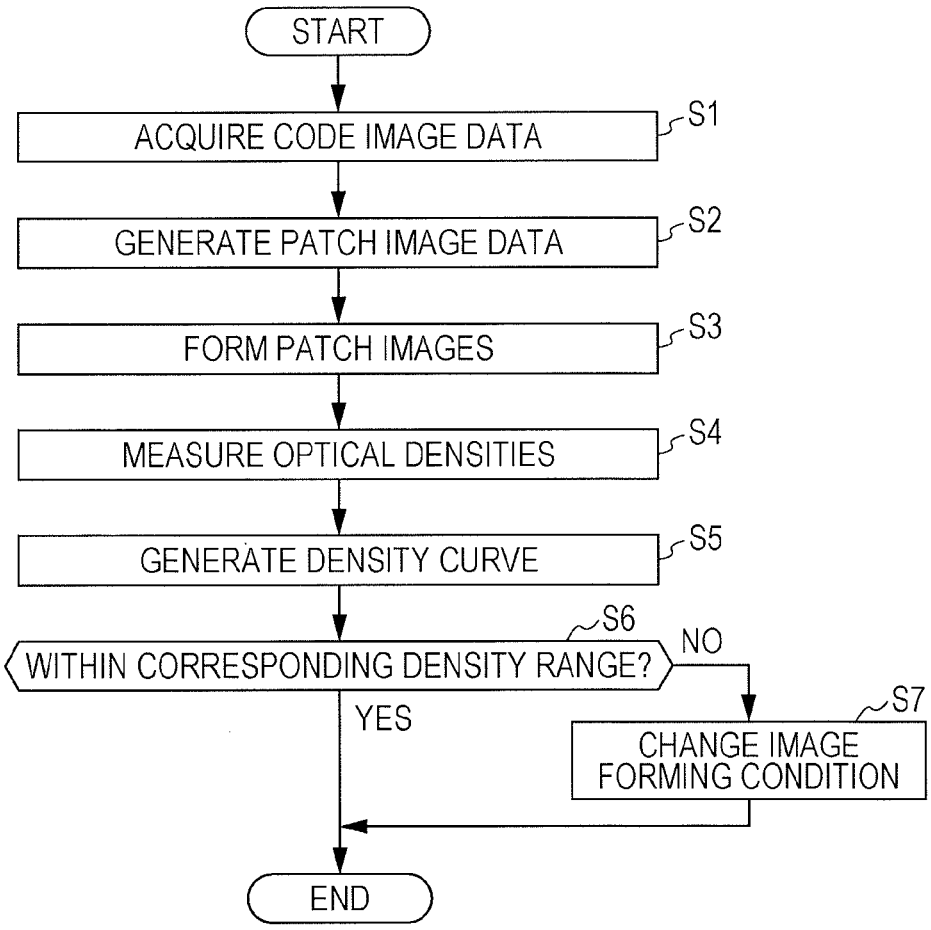
FIG. 4 is a flowchart illustrating a process for adjusting an image forming condition.
Figure 5:
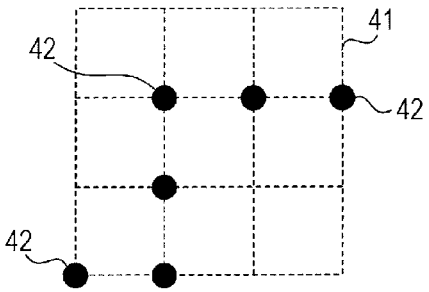
FIG. 5 illustrates an example of a code image.

When the image forming apparatus 1 receives a command for forming a code image 41, the image forming apparatus 1 performs a process for adjusting the image forming condition before forming the code image 41. The code image 41 expresses specific information based on an array of dots formed using the invisible toner. FIG. 4 is a flowchart illustrating the process for adjusting the image forming condition. In step S1, the controller 11 acquires code image data expressing the code image 41. For example, the controller 11 receives code image data transmitted from the terminal apparatus (not shown) via the communication unit 12. FIG. 5 illustrates an example of the code image 41. In the code image 41, six dots 42 are arranged in an array that expresses specific information. The dots 42 constituting the code image 41 all have the same size. The grid lines shown in FIG. 5 are imaginary lines and are not drawn in actuality.

Figure 6:
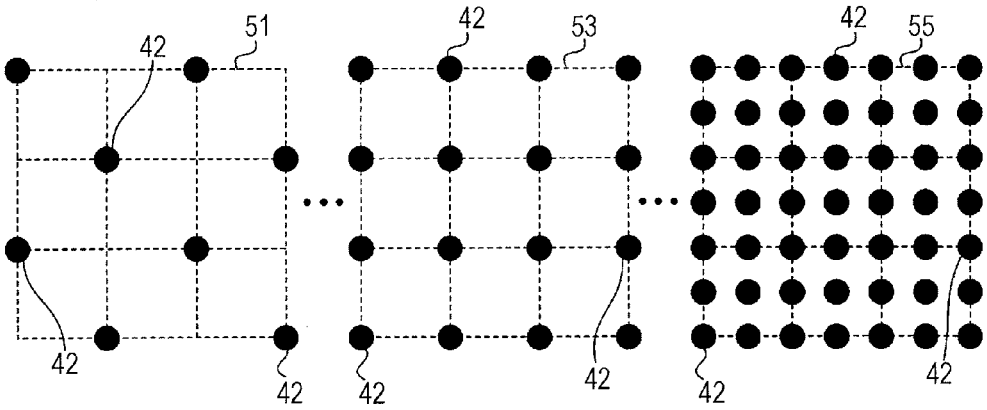
FIG. 6 illustrates an example of patch images.

In step S2, the controller 11 extracts the dots 42 from the code image 41 expressed by the acquired code image data. Then, the controller 11 generates patch image data expressing patch images 51 to 55 in which the extracted dots 42 are orderly arranged in different densities. FIG. 6 illustrates an example of the patch images 51 to 55. The patch images 51 to 55 have the same size. However, the patch images 51 to 55 have different numbers of dots 42 disposed therein. For example, the patch image 51 has eight dots 42 disposed therein. The patch image 53 has 16 dots 42 disposed therein. The patch image 55 has 49 dots 42 disposed therein. In this case, the density of the dots 42 is at a minimum in the patch image 51, and increases in the following order: the patch image 52, the patch image 53, the patch image 54, and the patch image 55. The number and the array of dots 42 in each of the patch images 51 to 55 are set in advance. Similar to FIG. 5, the grid lines shown in FIG. 6 are imaginary lines and are not drawn in actuality.

In step S3, the controller 11 supplies the generated patch image data to the image forming unit 14. Then, the controller 11 controls the image forming unit 14 so that the image forming unit 14 forms the patch images 51 to 55 in accordance with a present image forming condition by using the invisible toner. Under the control of the controller 11, the image forming unit 14 forms the patch images 51 to 55. Specifically, based on the patch image data supplied from the controller 11, the exposure device 23 exposes the photoconductor drum 21T, which is electrostatically charged, to light so as to form an electrostatic latent image thereon. With preset development potential, the developing device 24T develops the electrostatic latent image formed on the photoconductor drum 21T by using the invisible toner, thereby forming the patch images 51 to 55. Based on preset first transfer bias, the first-transfer roller 25T transfers the patch images 51 to 55 formed on the photoconductor drum 21T onto the intermediate transfer belt 26.

Figure 7:
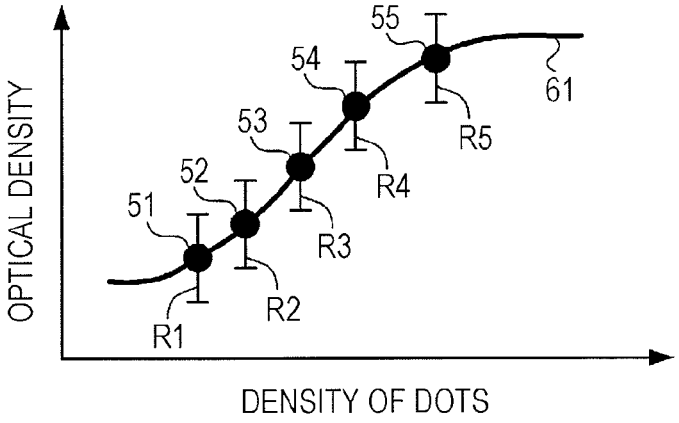
FIG. 7 illustrates an example of a density curve.

In step S4, the density sensor 15T measures the optical densities of the patch images 51 to 55 on the intermediate transfer belt 26. In step S5, the controller 11 generates a density curve 61 on the basis of the optical densities measured by the density sensor 15T. FIG. 7 illustrates an example of the density curve 61. The density curve 61 indicates a correspondence relationship between the densities of the dots 42 in the patch images 51 to 55 and the optical densities of the patch images 51 to 55. The densities of the dots 42 in the patch images 51 to 55 are stored in a memory when, for example, generating the patch image data.

In step S6, the controller 11 determines whether or not the optical densities of the patch images 51 to 55 are within corresponding density ranges R1 to R5. The density ranges R1 to R5 are respectively set in accordance with the densities of the dots 42 in the patch images 51 to 55, respectively. For example, each of the density ranges R1 to R5 is an optical-density range in which, when the corresponding dots 42 are arranged in the same density as the corresponding patch image 51 to 55 and are formed of the invisible toner, the aforementioned dots 42 can be accurately read by a scanner that emits infrared light or ultraviolet light. If the optical densities of the patch images 51 to 55 are within the corresponding density ranges R1 to R5 (YES in step S6), the controller 11 ends the process without changing the image forming condition. In contrast, if at least one of the optical densities of the patch images 51 to 55 is outside the corresponding density range (NO in step S6), the controller 11 proceeds to step S7.

In step S7, the controller 11 changes the image forming condition so that the optical densities of the patch images 51 to 55 are set within the corresponding density ranges R1 to R5. Specifically, if the optical density of a patch image is greater the corresponding density range, the controller 11 changes the image forming condition so that the amount of invisible toner is reduced. If the optical density of the patch image is smaller than the corresponding density range, the controller 11 changes the image forming condition so that the amount of invisible toner is increased. The image forming condition to be changed in this case is, for example, the amount of invisible toner in the developing device 24T (an example of a developing condition), the development potential of the developing device 24T (an example of a developing condition), or the first transfer bias of the first-transfer roller 25T (an example of a transfer condition). For example, in the case where the amount of invisible toner in the developing device 24T is to be changed, the amount of invisible toner in the developing device 24T is reduced if the optical density of the patch image is greater than the corresponding density range, whereas the amount of invisible toner in the developing device 24T is increased if the optical density of the patch image is smaller than the corresponding density range. In the case where the development potential is to be changed, the development potential is reduced if the optical density of the patch image is greater than the corresponding density range, whereas the development potential is increased if the optical density of the patch image is smaller than the corresponding density range.

Upon completion of the process shown in FIG. 4, the image forming apparatus 1 forms the code image 41 on a recording medium. If the image forming condition is changed in step S7, the code image 41 is formed in accordance with the changed image forming condition. Consequently, the code image 41 is formed using an appropriate amount of invisible toner. When the code image 41 is formed using an appropriate amount of invisible toner in this manner, the code image 41 is difficult to visually recognize. Furthermore, the code image 41 formed on the recording medium is read by a reading device, such as a scanner that emits infrared light or ultraviolet light. Accordingly, the specific information expressed by the array of dots 42 is recognized. As mentioned above, the code image 41 is formed of an appropriate amount of invisible toner. Therefore, when the code image 41 is to be read by the reading device, the dots 42 included in the code image 41 are accurately read. This improves the reliability of reading the code image 41.

The present invention is not limited to the exemplary embodiment described above, and modifications are permissible as follows. The following modifications may also be combined with each other.

First Modification

The determination process in step S6 may be performed using only the optical densities of patch images located in the central region of the density curve 61. This is due to the fact that the sensitivity of the optical densities of the patch images located in the central region of the density curve 61 is higher than that of the optical densities of the patch images located at the ends of the density curve 61. For example, in the density curve 61 shown in FIG. 7, only the optical densities of the patch images 52 to 54 are used, whereas the optical densities of the patch image 51 with the minimum density of dots 42 and the patch image 55 with the maximum density of dots 42 are not used. In this case, the controller 11 changes the image forming condition if at least one of the optical densities of the patch images 52 to 54 is outside the corresponding density range. In contrast, when the optical densities of the patch images 52 to 54 are within the corresponding density ranges R2 to R4, the controller 11 does not change the image forming condition even if the optical density of the patch image 51 or 55 is outside the corresponding density range.

In this modification, not all of the optical densities of the patch images 52 to 54 need to be used. For example, only the optical density of the patch image 52 and the optical density of the patch image 54 may be used. In other words, among the patch images 51 to 55, the controller 11 may perform the determination process in step S6 by using some of or all of the patch images excluding the patch image 51 with the minimum density of dots 42 and the patch image 55 with the maximum density of dots 42.

Second Modification

Figure 8:
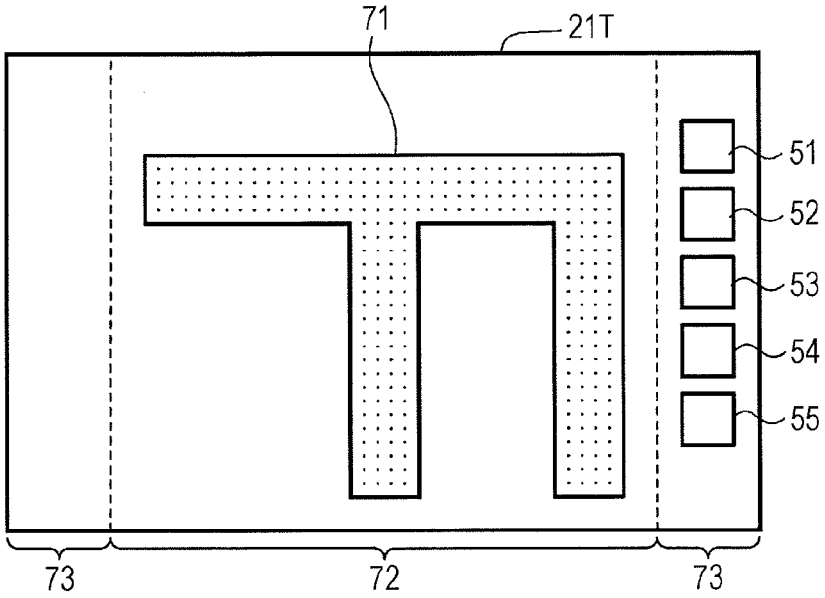
FIG. 8 illustrates an example of patch images formed in accordance with a modification.

When forming a color image, the image forming apparatus 1 may form the patch images 51 to 55 in addition to the color image. In this case, the color image is an image other than the code image 41. The color image is formed using, for example, at least one of yellow, magenta, cyan, and black toners. FIG. 8 illustrates an example of the patch images 51 to 55 formed in accordance with this modification. When a color image 71 is to be formed by the image forming unit 14, the controller 11 controls the image forming unit 14 so that the image forming unit 14 forms the color image 71 in an image region 72 (an example of a first region) and the patch images 51 to 55 in a non-image region 73 (an example of a second region). Under the control of the controller 11, the image forming unit 14 forms the color image 71 in the image region 72 and the patch images 51 to 55 in the non-image region 73. The non-image region 73 corresponds to a region in the photoconductor drum 21T that is not used for forming the color image 71. The non-image region 73 corresponds to, for example, an end of the photoconductor drum 21T. If color images 71 are to be continuously formed, the non-image region 73 may be a region between image regions 72 in which the color images 71 are formed.

Third Modification

In addition to the density sensor 15T, the image forming apparatus 1 may include density sensors 15Y, 15M, 15C, and 15K. When a color image is to be formed, the density sensors 15Y, 15M, 15C, and 15K measure the densities of a yellow image, a magenta image, a cyan image, and a black image, respectively. When the patch images 51 to 55 are to be formed, the density sensors 15Y, 15M, 15C, and 15K measure the optical densities of the patch images 51 to 55 together with the density sensor 15T. The density sensors 15Y, 15M, 15C, and 15K are provided above the intermediate transfer belt 26. The density sensors 15Y, 15M, 15C, 15K, and 15T are arranged in the width direction of the intermediate transfer belt 26.

Figure 9:
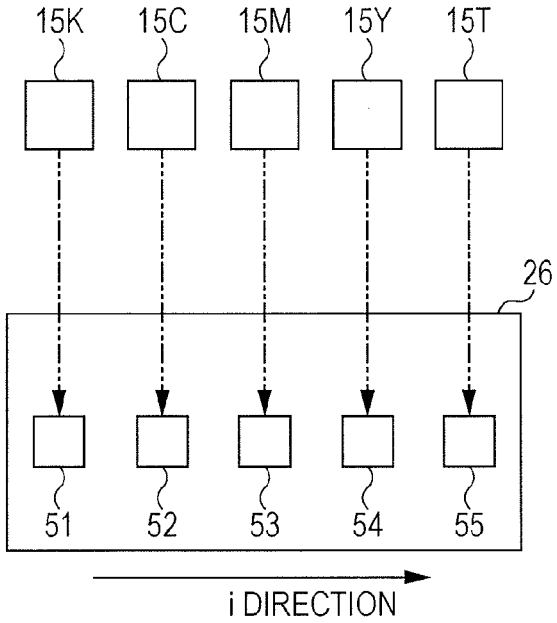
FIG. 9 illustrates an example of patch images formed in accordance with another modification.

FIG. 9 illustrates an example of the patch images 51 to 55 formed in accordance with this modification. The controller 11 generates patch image data expressing the patch images 51 to 55 arranged in an i direction. The i direction corresponds to an axial direction of the photoconductor drum 21T (i.e., a main scanning direction of the exposure device 23). In this case, the image forming unit 14 forms the patch images 51 to 55 arranged in the main scanning direction by using the invisible toner. In the case where the patch images 51 to 55 are arranged in the main scanning direction in this manner, the time required for the exposure and development processes is shortened, as compared with a case where the patch images 51 to 55 are arranged in the sub scanning direction. Subsequently, the patch images 51 to 55 are transferred onto the intermediate transfer belt 26. In this case, the patch images 51 to 55 are arranged in the width direction of the intermediate transfer belt 26. Specifically, the i direction in which the patch images 51 to 55 are arranged corresponds to the width direction of the intermediate transfer belt 26. As shown in FIG. 9, the density sensors 15K, 15C, 15M, 15Y, and 15T measure the optical densities of the patch images 51 to 55, respectively. Because the patch images 51 to 55 and the density sensors 15K, 15C, 15M, 15Y, and 15T are both arranged in the width direction of the intermediate transfer belt 26, the optical densities of the patch images 51 to 55 are measured substantially at the same time.

Fourth Modification

Figure 10:
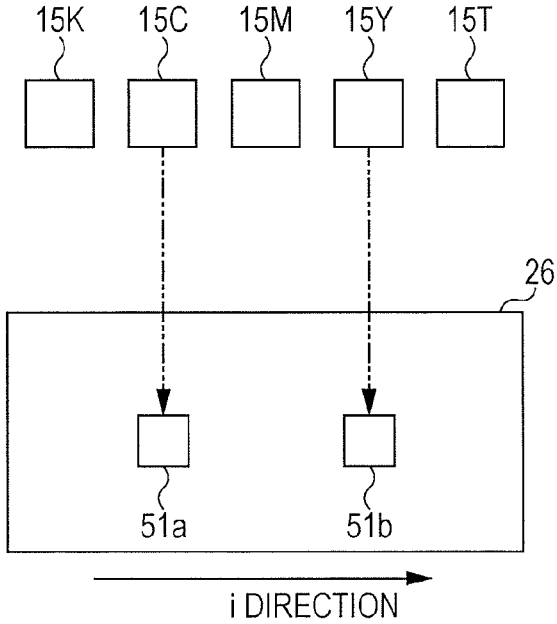
FIG. 10 illustrates an example of patch images formed in accordance with yet another modification.

If the image forming apparatus 1 includes multiple density sensors as in the third modification, multiple identical patch images may be formed for correcting in-plane unevenness. This in-plane unevenness occurs when the image density is uneven within the same plane of a recording medium. FIG. 10 illustrates an example of patch images 51*a* and 51*b* formed in accordance with this modification. The controller 11 generates patch image data expressing the patch images 51*a* and 51*b* arranged in the i direction. The i direction corresponds to the main scanning direction of the exposure device 23 (i.e., the axial direction of the photoconductor drum 21T). The patch images 51*a* and 51*b* are constituted of identical dots 42 and have identical dot densities. In this case, the image forming unit 14 forms the patch images 51*a* and 51*b* arranged in the main scanning direction by using the invisible toner. Subsequently, the patch images 51*a* and 51*b* are transferred onto the intermediate transfer belt 26. In this case, the patch images 51*a* and 51*b* are arranged in the width direction of the intermediate transfer belt 26. Specifically, the i direction in which the patch images 51*a* and 51*b* are arranged corresponds to the width direction of the intermediate transfer belt 26. As shown in FIG. 10, the density sensors 15C and 15Y measure the optical densities of the patch images 51*a* and 51*b*, respectively.

After the optical densities of the patch images 51*a* and 51*b* are respectively measured by the density sensors 15C and 15Y, the controller 11 compares the optical density of the patch image 51*a* and the optical density of the patch image 51*b* with each other. If the optical densities are different, the controller 11 changes the image forming condition so as to reduce the density difference therebetween. The image forming condition to be changed in this case is, for example, the development potential. For example, if the optical density of the patch image 51*a* is greater than the optical density of the patch image 51*b*, the development potential for a region in which the patch image 51*a* is formed is reduced, whereas the development potential for a region in which the patch image 51*b* is formed is increased.

In this modification, the image forming apparatus 1 may form a patch image that includes multiple regions arranged in the i direction. In this case, the density sensors 15C and 15Y measure the optical densities of different regions in the patch image. The controller 11 compares the optical densities of the multiple regions in the patch image. If the optical densities are different, the controller 11 changes the image forming condition so as to reduce the density difference therebetween.

Fifth Modification

Figure 11:
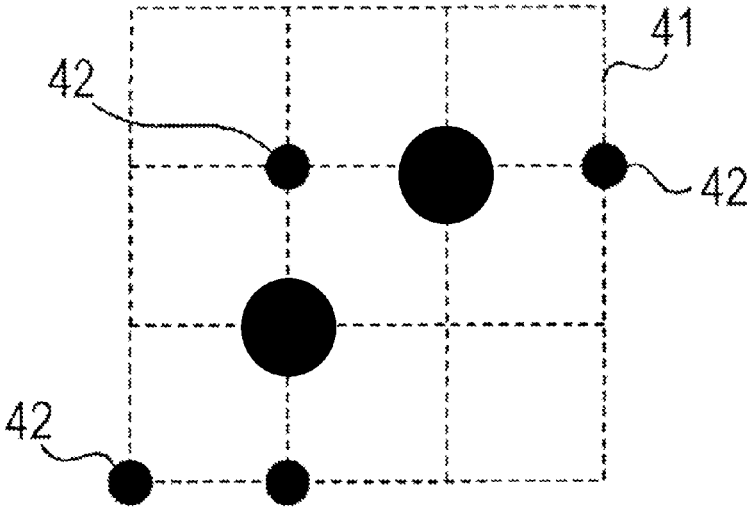
FIG. 11 illustrates an example of a coded image having different sized dots.

As shown in FIG. 11, the code image 41 may be constituted of multiple dots having different sizes. For example, if the code image 41 is constituted of large dots and small dots, the controller 11 extracts the large dots and the small dots from the code image 41. Then, the controller 11 generates first patch image data expressing multiple patch images in which the large dots are arranged, and second patch image data expressing multiple patch images in which the small dots are arranged. In this case, the controller 11 performs step S3 and onward for each generated patch image data.

Sixth Modification

The image forming apparatus 1 may form a color patch image. This color patch image is formed, for example, with a predetermined gradation by using yellow, magenta, cyan, and black toners. In this case, the controller 11 may form the patch images 51 to 55 more frequently than the color patch image.

Seventh Modification

The number of patch images is not limited to five, and may be five or more. Moreover, the number of dots 42 and the array of dots 42 in each patch image are not limited to those in the example shown in FIG. 6. The number of dots 42 is not limited so long as the densities of dots 42 differ among multiple patch images. Furthermore, the array of dots 42 is not limited so long as the dots 42 are orderly arranged.

Eighth Modification

In the exemplary embodiment, the image forming condition is changed if at least one of the optical densities of the patch images 51 to 55 is outside the corresponding density range. However, if the number of optical densities outside the corresponding density ranges is equal to or smaller than a threshold value, the image forming condition may be left unchanged. For example, if there is only one optical density that is outside the corresponding density range, the image forming condition may be determined as being substantially acceptable, and the image forming condition may thus be left unchanged.

Ninth Modification

The image forming condition may be a parameter other than the amount of invisible toner in the developing device 24T, the development potential, and the first transfer bias so long as the parameter is used for controlling the amount of invisible toner for forming the code image 41.

Tenth Modification

The controller 11 may include an application specific integrated circuit (ASIC). In this case, the function of the controller 11 may be achieved by the ASIC alone or by both the ASIC and the CPU. Furthermore, the controller 11 and the density sensor 15T may be provided as a control device.

Eleventh Modification

The program for achieving the function of the controller 11 may be stored in a computer-readable storage medium, such as a magnetic storage medium (e.g., a magnetic tape, a magnetic disk (hard disk drive (HDD), flexible disk (FD)), etc.), an optical storage medium (e.g., an optical disk (compact disc (CD), digital versatile disk (DVD)), etc.), a magneto-optical storage medium, or a semiconductor memory, and may be installed in the image forming apparatus 1. Alternatively, the program may be installed by being downloaded via a communication line.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A control device comprising:

an acquiring unit that acquires code image data expressing a code image having dots that form a dot pattern such that information is embedded;

a generating unit that extracts the dots from the code image expressed by the acquired code image data, and generates patch image data expressing a plurality of patch images in which the extracted dots are orderly arranged in different densities;

an image-formation control unit that controls an image forming unit to form the plurality of patch images on the basis of the generated patch image data in accordance with a preset image forming condition by using an invisible toner that absorbs infrared light or ultraviolet light;

a measuring unit that measures densities of the plurality of patch images formed by the image forming unit; and a changing unit that changes the image forming condition in response to at least one of the measured densities being outside of a density range that is set in accordance with a density of the corresponding dots based on a correspondence relationship between the measured densities and densities of the dots in the plurality of patch images, so that all of the measured densities are set within corresponding density ranges set in accordance with the densities of the corresponding dots.

2. The control device according to claim 1, wherein the image forming unit includes:

a charging section that electrostatically charges an image bearing member;

an exposure section that exposes the electrostatically-charged image bearing member to light so as to form a latent image thereon, a developing section that develops the formed latent image by using the invisible toner so as to form a toner image; and a transfer section that transfers the formed toner image from the image bearing member to a transfer medium; and wherein the image forming condition includes a developing condition of the developing section or a transfer condition of the transfer section.

3. The control device according to claim 2, wherein the plurality of patch images include a first patch image with a minimum density of the dots, a second patch image with a maximum density of the dots, and a third patch image other than the first and second patch images, and wherein the changing unit changes the image forming condition in response to the density of the third patch image being outside the corresponding density range set in accordance with the density of the corresponding dots.

4. The control device according to claim 3, wherein the measuring unit includes a plurality of measuring units, wherein the image forming unit includes the image bearing member that rotates about an axis and has the plurality of patch images formed on a surface thereof, wherein the generating unit generates the patch image data that expresses the plurality of patch images arranged in an axial direction of the image bearing member, and wherein the plurality of measuring units measure the densities of the patch images, which are different from each other.

5. The control device according to claim 2, wherein the measuring unit includes a plurality of measuring units, wherein the image forming unit includes the image bearing member that rotates about an axis and has the plurality of patch images formed on a surface thereof, wherein the generating unit generates the patch image data that expresses the plurality of patch images arranged in an axial direction of the image bearing member, and wherein the plurality of measuring units measure the densities of the patch images, which are different from each other.

6. The control device according to claim 2, wherein one of the patch images includes a plurality of regions arranged in a main scanning direction of the exposure section, wherein the measuring unit measures densities of the plurality of regions included in the patch image, and wherein in response to the densities of the plurality of regions measured by the measuring unit being different from each other, the changing unit changes the developing condition of the developing section so as to reduce the difference in the densities.

7. The control device according to claim 1, wherein the plurality of patch images include a first patch image with a minimum density of the dots, a second patch image with a maximum density of the dots, and a third patch image other than the first and second patch images, and wherein the changing unit changes the image forming condition in response to the density of the third patch image being outside the corresponding density range set in accordance with the density of the corresponding dots.

8. The control device according to claim 7, wherein the measuring unit includes a plurality of measuring units, wherein the image forming unit includes an image bearing member that rotates about an axis and has the plurality of patch images formed on a surface thereof, wherein the generating unit generates the patch image data that expresses the plurality of patch images arranged in an axial direction of the image bearing member, and wherein the plurality of measuring units measure the densities of the patch images, which are different from each other.

9. The control device according to claim 1, wherein the measuring unit includes a plurality of measuring units, wherein the image forming unit includes an image bearing member that rotates about an axis and has the plurality of patch images formed on a surface thereof, wherein the generating unit generates the patch image data that expresses the plurality of patch images arranged in an axial direction of the image bearing member, and wherein the plurality of measuring units measure the densities of the patch images, which are different from each other.

10. The control device according to claim 1, wherein the image forming unit forms a color image other than the code image, and wherein when the color image is to be formed by the image forming unit, the image-formation control unit controls the image forming unit so that the image forming unit forms the color image in a first region and the plurality of patch images in a second region that is not used for forming the color image.

11. The control device according to claim 1, wherein in response to the dots in the code image including first dots and second dots having different sizes, the generating unit extracts the first dots and the second dots and generates first patch image data expressing a plurality of patch images in which the first dots are orderly arranged in different densities and second patch image data expressing a plurality of patch images in which the second dots are orderly arranged in different densities.

12. An image forming apparatus comprising:

the control device according to claim 1; and the image forming unit that forms the plurality of patch images under the control of the image-formation control unit on the basis of the generated patch image data in accordance with the preset image forming condition by using the invisible toner that absorbs infrared light or ultraviolet light.

13. The control device according to claim 1, wherein the extracted dots are orderly arranged in a grid.

14. The control device according to claim 1, wherein the code image includes first dots and second dots that have different sizes.

15. A control method comprising:

acquiring code image data expressing a code image having dots that form a dot pattern such that information is embedded;

extracting the dots from the code image expressed by the acquired code image data;

generating patch image data expressing a plurality of patch images in which the extracted dots are orderly arranged in different densities;

controlling an image forming unit to form the plurality of patch images on the basis of the generated patch image data in accordance with a preset image forming condition by using an invisible toner that absorbs infrared light or ultraviolet light;

measuring densities of the plurality of patch images formed by the image forming unit; and changing the image forming condition in response to at least one of the measured densities of the plurality of patch images being outside a density range that is set in accordance with a density of the corresponding dots based on a correspondence relationship between the measured densities and densities of the dots in the plurality of patch images, so that all of the measured densities are set within corresponding density ranges set in accordance with the densities of the corresponding dots.

* * * * *